United States Patent [19]

Kelch

[11] Patent Number: 4,907,943

[45] Date of Patent: Mar. 13, 1990

[54] METHOD AND APPARATUS FOR ASSESSING THRUST LOADS ON ENGINE BEARINGS

[75] Inventor: George W. Kelch, Palm Beach Gardens, Fla.

[73] Assignee: United Technologies Corporation, Hartford, Conn.

[21] Appl. No.: 198,330

[22] Filed: May 25, 1988

[51] Int. Cl.[4] ..... F02C 7/00

[52] U.S. Cl. ..... 415/1; 415/104; 415/118; 73/862.49

[58] Field of Search ..... 415/1, 14, 34, 104, 415/106, 107, 118; 73/862.49

[56] References Cited

U.S. PATENT DOCUMENTS

| | | | |
|---|---|---|---|
| 1,298,630 | 3/1919 | Schmidt | 73/862.49 |
| 2,530,477 | 11/1950 | Ostmar | 415/104 |
| 2,647,684 | 8/1953 | Lombard | 415/104 |
| 2,746,671 | 5/1956 | Newcomb | 415/104 |
| 3,433,020 | 3/1969 | Earle et al. | 415/106 |
| 3,828,610 | 8/1974 | Swearingen | 415/104 |
| 4,578,018 | 3/1986 | Pope | 415/14 |
| 4,730,977 | 3/1988 | Haaser | 415/104 |

*Primary Examiner*—Louis J. Casaregola

*Attorney, Agent, or Firm*—McCormick, Paulding & Huber

[57] ABSTRACT

In a gas turbine engine a novel method and apparatus that measures axial thrust loads in engine bearings is characterized by a controller which dynamically selects axial loads on an engine thrust bearing by varying internal gas pressures in bearing trim cavities in accordance with a predetermined schedule.

3 Claims, 3 Drawing Sheets

METHOD AND APPARATUS FOR ASSESSING THRUST LOADS ON ENGINE BEARINGS

TECHNICAL FIELD

This invention relates to gas turbine engine controllers and more particularly to gas turbine engine controllers which measure and adjust thrust loads on rotor bearings.

BACKGROUND OF THE INVENTION

It is well known that air flow through a gas turbine engine generates axial loads on rotors in gas turbine engines and have a strong influence on the life of a rotor's axial thrust bearings. Thrust loads are determined by internal engine air flow, internal engine compartment air pressures, seals and seal locations, as well as airfoil aerodynamic loads. All are integral components of the summed load on the rotor bearings and are configured to load the axial bearings only within a selected range. Advanced engine designs endeavor to reduce the magnitude and range of the bearing load in order to achieve lower bearing weights and longer bearing lifetimes.

The conventional method for measuring axial thrust loads on rotor bearings requires special load cell support rings to be incorporated into the thrust bearing support structure. As is known in the art, each separate engine type must have that bearing support structure modified to receive a specifically designed load cell support ring. The support ring is installed only for test purposes and must be removed before placing the engine in service. This measurement technique is elaborate and very expensive and is not available on engines in service.

The special instrumentation previously required to measure axial thrust load on rotor bearings includes mechanical strain gauges that are configured into a special bearing support ring. The support ring must be physically installed in the bearing assembly during thrust load measurements and removed prior to placing the engine in service. The physical installation of the instrumented bearing support ring required additional radial clearance of the bearing outer race. This alters the rotor system dynamics response and may limit the operating envelope of the engine. Smaller engines present a more difficult problem since the clearances within these engines are themselves smaller which makes load deviations more sensitive to manufacturing tolerances. Also, small engines have less available space for instrumentation. Moreover, the thrust loads measured by these strain gauges are small enough in magnitude to be outside the load range of conventional mechanical load cell techniques. In addition, known methods for measuring axial thrust loads must further differentiate between bearing loads induced by axial thrust and thermally induced loads.

It would be advantageous to have a method and apparatus incorporated into the design of a gas turbine engine so that the axial thrust loads on the rotors of an engine are established as part of the engine calibration. In addition, it would also be desirable to have a method and apparatus which can dynamically adjust rotor axial thrust loads as part of the engine scheduled maintenance to compensate for engine deterioration and seal wear. The present invention is drawn to such a method and apparatus.

SUMMARY OF INVENTION

It is an object of the present invention to provide a method and apparatus for assessing thrust loads on gas turbine engine rotor bearings that does not require load cell instrumentation.

Another object of the present invention is to provide a method and apparatus for assessing thrust loads on gas turbine engine bearings without affecting rotor bearing radial support clearance.

Another object of the present invention is to provide a method and apparatus for assessing thrust loads on gas turbine engine bearings while those engines are in service.

Another object of the present invention is to provide a method and apparatus for assessing thrust loads on gas turbine engine bearings and adjusting the bearing thrust load during scheduled maintenance operations.

Still another object of the present invention is to provide a method and apparatus for adjusting axial trim cavity pressure to provide continuous regulation of axial thrust loads on gas turbine engine rotor bearings.

According to the present invention, an apparatus for use in a gas turbine engine having a rotor positioned along a longitudinal axis by an axial bearing, said apparatus indicating axial rotor loads without a load cell support ring, and including a measurement means for providing signals indicative of the longitudinal position of the rotor in the bearings. Also included is a computer that receives the measured rotor position signals and generates therefrom signals indicative of axial thrust load on the rotor.

According to another aspect of the present invention an apparatus for use in a gas turbine engine having a rotor positioned along the longitudinal axis by an axial bearing, said apparatus for selecting longitudinal rotor position and including a measuring apparatus that provides signals indicative of the longitudinal position of the rotor in the bearing as well as a displacement mechanism which selectively displaces the rotor along the longitudinal axis in response to control signals. The apparatus further includes a controller which receives the measured rotor position signals and computes axial load on the rotor. Also, the controller compares the measured rotor position signals with the load signals and provides therefrom control signals to the rotor displacement mechanism to select an axial rotor position.

DESCRIPTION OF THE PREFERRED EMBODIMENT

Figure 1:
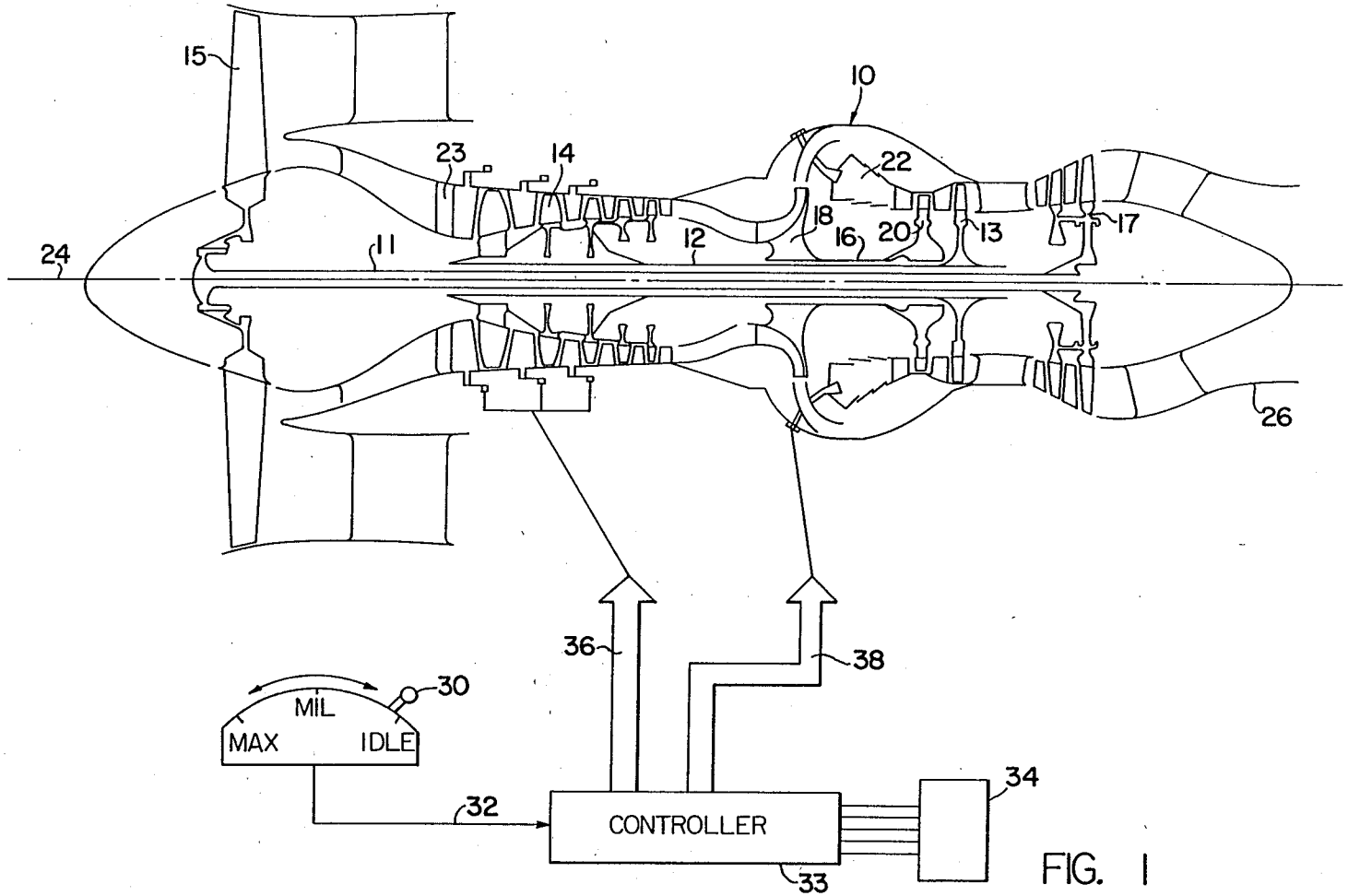
FIG. 1 is a simplified cross sectional illustration of a gas turbine engine with a controller having an apparatus for determining thrust loads on engine bearings in accordance with the present invention.

Referring now to FIG. 1 there is illustrated, in schematic form, a gas turbine engine 10 which is a conventional three spool type having a spool 11 including a power turbine 17 driving the fan 15 and a spool 12 including a low turbine 13 driving a low compressor 14 and a spool 16 having a high pressure compressor 18 and high pressure turbine 20. A conventional burner 22, disposed between the compressor exit and turbine inlet serves to heat and accelerate the gas sufficiently to power the turbines and generate thrust. In the figures, gas moves through the engine from left to right by means of a primary engine gas flow path 23. Those skilled in the art will note that the engine contains additional, secondary gas paths not detailed herein. These secondary paths channel the engine internal gas flow.

The high pressure spool, low pressure spool and fan spool are disposed along a longitudinal axis 24 of the engine. The spools are not mechanically connected to each other, but rotate independently. The engine may or may not also include an augmentor (not illustrated) receiving discharged gas from the power turbine. The gas exits the engine via an exhaust nozzle 26.

The pilot controls engine power by means of throttle level 30. The angle of the throttle lever as well as the rate of change of throttle lever angle is determinative of the amount of power supplied by the engine. Signals indicative thereof are provided on lines 32 to the controller 33. A plurality of engine sensors, indicated schematically at 34, provide the controller with corresponding engine parameter signals. Control signals are output to operate the engine on lines 36, 38.

Figure 2:
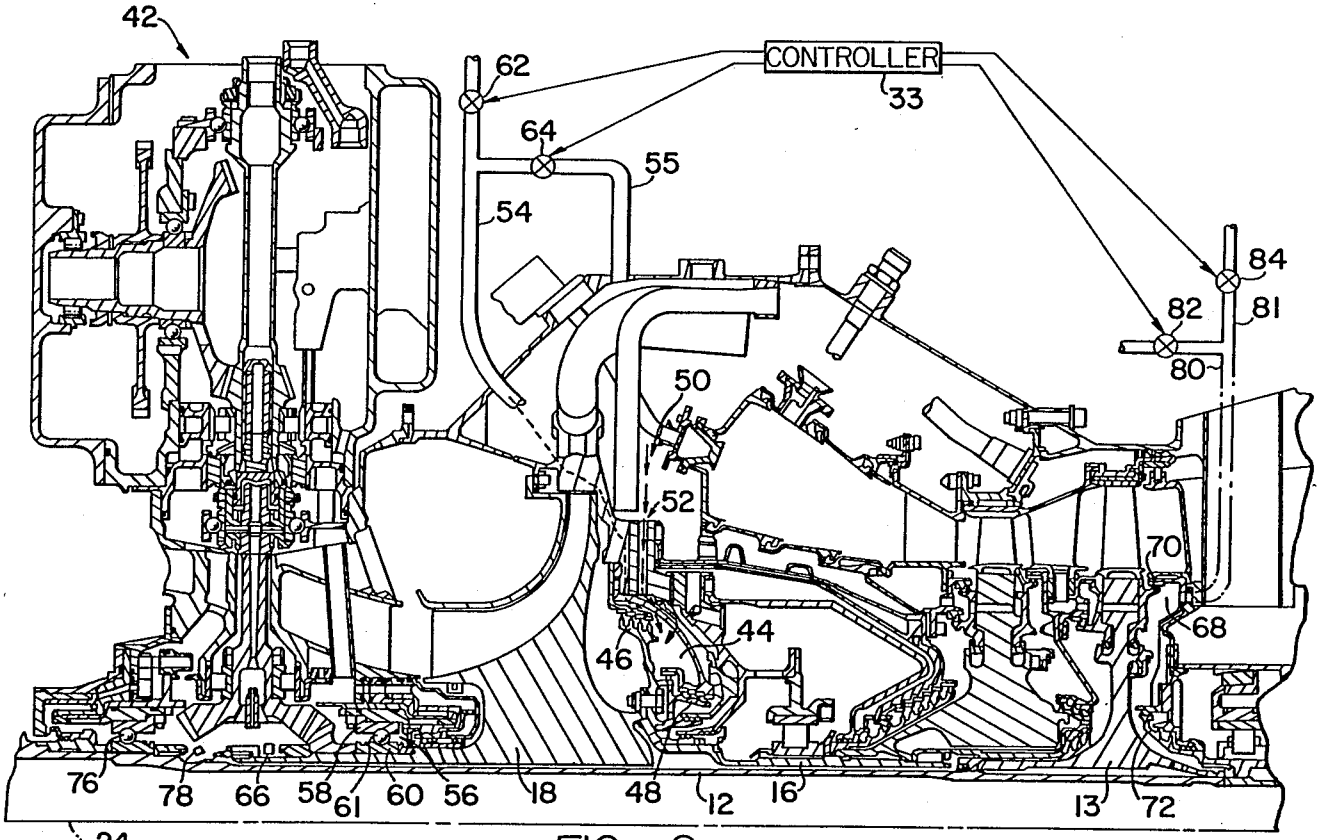
FIG. 2 is an expanded, sectional illustration of an upper, central portion of the jet engine shown in FIG. 1.

Referring to FIG. 2, there is illustrated in section an upper, central portion of the jet engine 10 of FIG. 1. Spools 11, 12 and 16 rotate about axis 24. Those skilled in the art will recognize a number of conventional engine component groups, such as engine start tower 42, are illustrated in limited detail for purposes of illustrative clarity. A high spool axial thrust trim cavity 44 is located downstream of the high compressor (impeller) 18 between labyrinth seals 46 and 48. During normal engine operation, trim cavity 44 is pressurized with air extracted upstream of combuster 50 and throttled through control area 52 to pressurize the trim cavity 44 at a pressure value that is intermediate to the high compressor exit total and static pressures. Air line 54 is also routed from the trim cavity to the exterior of the engine, and externally connected to air line 55 which is valved to metered high pressure air extracted from the engine burner case. Those skilled in the art will note that air lines 54,55 are only schematically shown and are conventionally configured on the engine case in the preferred embodiment. Thrust bearing 56 is conventional and is comprised of outer and inner races 58 and 60 and a plurality of balls, such as ball 61.

As described hereinafter, it is necessary to correlate the pressure in the trim cavity 44 with the axial load and position of thrust bearing 56. To establish this relationship, the loading on the bearing is varied so that its axial position changes. Initially, the high spool axial thrust load trim control valves 62 and 64 are closed, and the high spool axial thrust load is selected to be at its base or initial load condition. For those engines where the high spool is initially forward loaded, the null load position is approached by bleeding air to the exterior of the engine through control valve 62. For engines such as a Pratt and Whitney PW3005, the thrust bearing 56 is preferably rearward loaded on the outer race aft surface by a select amount (approximately 417 lbs.) at the bearing's aero-design point. The high spool axial thrust trim cavity pressure is increased by opening control valve 64 to increase forward loading on the spool. As the pressure in trim cavity 44 is increased, the thrust bearing ball 61 shifts forward, allowing the spool axial position to move on the order of 6 to 12 thousands of an inch. The position of the thrust bearing ball is measured by proximity probe 66 which, in the preferred embodiment, comprises an electromagnetic sensor positioned adjacent to the rotating bearing elements.

Probe 66 provides signals indicative of the spool axial position to controller 33 which then computes the deviation in thrust trim cavity pressure needed to shift the bearing ball to a position in between the forward-to-aft bearing races, defined as the null position, which also corresponds to the null load condition. The bearing is subjected to zero axial load at the null load condition. The deviation in thrust trim cavity pressure is defined as the difference between the trim cavity pressure corresponding to the base load and the trim cavity pressure at the null load condition. The load deviation is defined to be the product of the thrust trim cavity pressure deviation and the trim cavity axial area. Thus, the ball bearing axial load at the base condition is determined, and is equal to the load deviation. Alternatively, the deviation in axial thrust load is the difference between the high spool axial load prior to the opening of control valve 64 and that load value measured when the spool is moved to the null load position.

The axial thrust load for the high spool base condition, that is with both valves 62 and 64 closed, can be changed by altering the pressure of control area 52 by means of throttled air extracted upstream of the burner. In the preferred embodiment, the control area 52 consists of 13, 0.25 inch diameter threaded holes selectively plugged to establish the base load. The high spool axial thrust load adjustment air lines 54 and 55 are external to the engine, and, together with control valves 62 and 64, comprise special test equipment, for engines such as shown in FIG. 1 that do not provide continuous and interactive axial load control. Once the calibration procedure detailed above has been completed, the special test equipment is removed from the engine by simply capping the lines where they exit the engine case.

Similarly, a low spool axial thrust trim cavity 68 is located aft or downstream of the low turbine 13 between labyrinth seals 70 and 72. Low spool axial trim cavity 68 is normally pressurized with air bled from around the bore of the low pressure turbine and combined with low pressure compressor (LPC) buffer air from seal 72 which discharges air into the primary engine gas flow path through seal 70. The low spool is designed to be forward loaded approximately 525 lbs. in the preferred embodiment. This load is resisted by low spool thrust bearing 76. A second proximity probe 78 similar to the first is positioned to measure changes in thrust bearing 76 position in a manner similar to that described hereinabove with respect to thrust bearing 56. The low spool axial thrust trim cavity is also configured with special test equipment air lines 80,81, which are outside of the engine, as are air line control valves 82 and 84. The low spool thrust trim cavity pressure can be reduced by bleeding air to the exterior of the engine through control valve 84. This reduction of air pressure reduces the forward load on the spool in the preferred embodiment.

Axial thrust load on the low spool and the correlation between thrust trim cavity pressure and spool position are determined in the manner described hereinabove with respect to the high spool. The low spool axial thrust load is the product of the axial area of trim cavity 68 and the cavity pressure deviation to achieve the null pressure. For those engines where the low spool is initially aft loaded, the null load position is approached by pressurizing trim cavity 68 with low pressure compressor (LPC) air via control valve 82.

Figure 3:
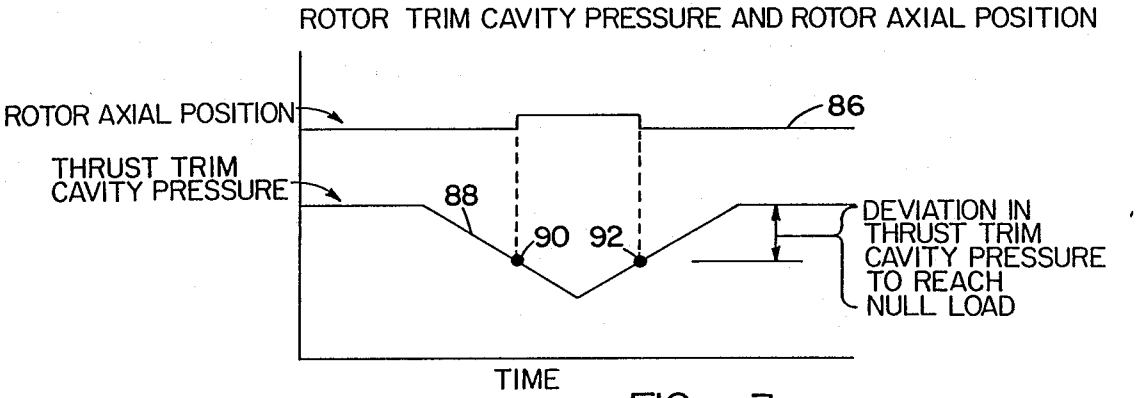
FIG. 3 is a diagrammatic illustration relating rotor axial position to trim cavity pressure.

FIG. 3 is a diagrammatic illustration showing the axial position of a given rotor and the corresponding thrust trim cavity pressure as the cavity pressure is cycled over time. Curve 86 corresponds to the rotor axial position, while curve 88 corresponds to the thrust trim cavity pressure. As indicated hereinabove, each thrust bearing is instrumented with a proximity probe to indicate ball axial location in a thrust bearing and corresponding rotor axial position. The thrust trim cavity pressure is cycled to find null load points 90, and 92.

Figure 4:
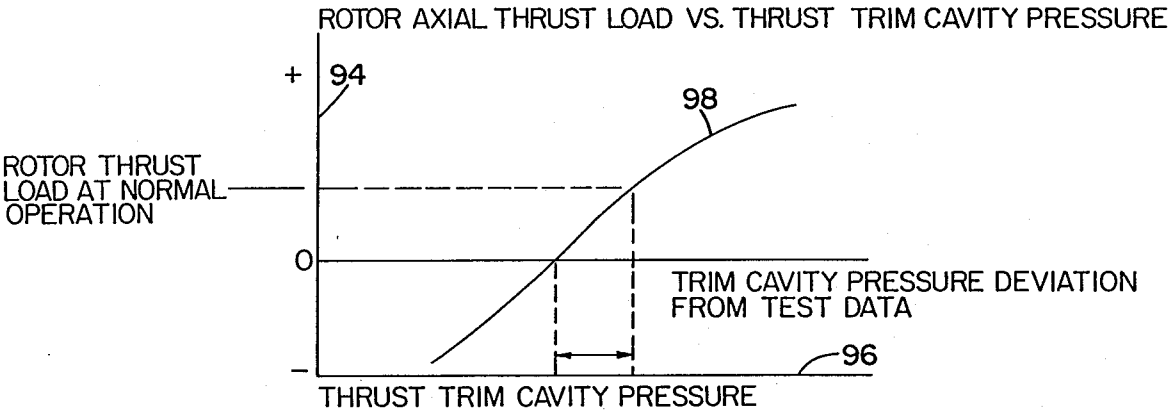
FIG. 4 is a diagrammatic illustration relating engine rotor thrust load to trim cavity pressure.

Once the deviation in thrust cavity pressure has been determined, the corresponding values of spool axial load can be computed by the controller as the product of the thrust trim cavity pressure deviation and the cavity axial area. In the diagrammatic illustration of FIG. 4, axes 94 and 96 correspond to rotor thrust load and thrust trim cavity pressure, respectively. Curve 98 corresponds to the computed axial thrust load as a function of thrust cavity pressure. A specific thrust cavity pressure corresponds to a specific rotor thrust load. Typically, the bearing axial thrust load assessment is required during the engine development program. Engines that are sensitive to bearing axial thrust loads can have those thrust loads adjusted by altering control area 52 pressure during the initial or "green" engine run and can also have axial thrust load adjustments performed during scheduled maintenance inspections to compensate for engine deterioration.

Although shown in FIG. 1 to have manual thrust load assessment only during calibration or routine maintenance, those skilled in the art will note that the method and apparatus for assessing engine bearing thrust load provided by the present invention can be readily adapted to provide continuous, interactive axial load control. A controller 33 configured to provide continuous interactive axial load control preferably comprises a conventional processor and sufficient memory means as is necesary to perform the functions described herein. During calibration, the controller receives bearing ball position signals from the probes 66 and 78 which indicate the axial positions of the rotors. Using known techniques, the controller correlates the measured bearing ball positions to the respective cavity trim pressures and computes rotor thrust load using conventional algorithms in accordance with the relationships outlined hereinabove. These computed relationships are stored in the controller and comprise a thrust load schedule. After calibration, the controller is programmed during engine operation to select the desired trim cavity pressures and hence the desired thrust loads. The controller generates corresponding signals to open and close programmable control valves by an amount needed to produce the desired pressures in the trim cavities.

Alternatively, the controller 33 may be programmed to simulate the trim cavity pressure deviation and corresponding deviation in bearing load using known numerical models. These models analyze engine internal gas flow and pressure as comprehensive system and are more precise than the method for computing trim cavity pressure and bearing load deviations detailed above, since they account for secondary effects on gas pressure changes within the engine.

Similarly, althought the invention has been shown and described with respect to a preferred embodiment thereof it should be understood by those skilled in the art that various other changes, omissions and additions thereto may be made therein without departing from the spirit and scope of the invention. Specifically, the present invention may be easily utilized with other gas turbine engines, which may or may not have a power turbine, a controlled or fixed area nozzle or with or without thrust augmentation.

I claim:

1. In an operating gas turbine engine having a rotor located by an axial bearing having first and second races, said rotor being displaceable relative to said bearing in accordance with an applied load along a longitudinal axis from said first race to said second race with a null position of zero load therebetween, and further having a selectively pressurized axial trim cavity capable of generating said axial bearing loads in accordance with the magnitude of pressure therein, a method for determining a value of null position trim cavity pressure, said method comprising the steps of:

varying the pressure in said axial trim cavity between low and high values;

measuring the axial position of said rotor within the bearing for each of said trim cavity pressure values;

determining from said measured rotor position values those values indicative of a shift in rotor position from said first race to said second race corresponding to said null position value of zero load; and determining from said measured null position value a corresponding value of trim cavity pressure.

2. In an operating gas turbine engine having a rotor located by an axial bearing having first and second races, said rotor being displaceable relative to said bearing in accordance with applied loads along a longitudinal axis from said first race to said second race with a null position of zero load therebetween, and further having a selectively pressurized axial trim cavity capable of generating said bearing axial loads in accordance with the magnitude of pressure therein, a method for use in selecting rotor load, said method comprising the steps of:

varying the pressure in said axial trim cavity between low and high values;

measuring the axial position of said rotor within the bearing for each of said trim cavity pressure values;

determining from said measured rotor position values those values indicative of a shift in rotor position from said first race to said second race corresponding to said null position value of zero load;

determining from said null position value a corresponding value of trim cavity pressure;

comparing said null position trim cavity pressure value with a predetermined null position trim cavity pressure value to determine a deviation value therefrom;

adjusting rotor load values pre-correlated with values of trim cavity pressure in accordance with said deviation value; and selecting a value of axial trim cavity pressure to generate a preferred value of rotor load.

3. In an operating gas turbine engine having a rotor located by an axial bearing having first and second races, said rotor being displaceable relative to said bearing in accordance with applied loads along a longitudinal axis from said first race to said second race with a null position of zero load therebetween, and further having a selectively pressurized axial trim cavity capable of generating said axial loads in accordance with the magnitude of pressure therein, a method for use in determining a value of null position deviation from a predetermined value thereof, said method comprising the steps of:

varying the pressure in said axial trim cavity between low and high values;

measuring the axial position of said rotor within the bearing for each of said trim cavity pressure values;

determining from said measured rotor position values those values indicative of a shift in rotor position from said first race to said second race corresponding to said null position value of zero load;

determining from said null position value a corresponding value of trim cavity pressure; and comparing said null position trim cavity pressure value with a predetermined null position trim cavity pressure value to determine said deviation value.

* * * * *